United States Patent [19]

Dixon

[11] 4,261,319

[45] Apr. 14, 1981

[54] FOOTBALL PASSING MACHINES

[75] Inventor: Jack R. Dixon, Las Vegas, Nev.

[73] Assignee: Fonas Corporation, Latrobe, Pa.

[21] Appl. No.: 85,406

[22] Filed: Oct. 17, 1979

[51] Int. Cl.[3] ..... F41B 7/00

[52] U.S. Cl. ..... 124/21; 124/80; 124/41 R; 124/35 R; 124/81; 273/55 R

[58] Field of Search ..... 124/21, 80, 17, 81, 124/16, 3 L, 41 R, 35 R, 31, 33; 273/55 R

[56] References Cited

U.S. PATENT DOCUMENTS

| | | | |
|---|---|---|---|
| 1,543,144 | 6/1925 | Wurm | 124/21 |
| 1,909,416 | 5/1933 | Nemmers | 124/33 |
| 3,207,144 | 9/1965 | Soderman | 124/21 |
| 3,926,170 | 12/1975 | Dixon | 124/41 R X |
| 3,951,125 | 4/1976 | Dixon | 124/41 R X |
| 4,086,901 | 5/1978 | Clement | 124/21 |

*Primary Examiner*—William R. Browne

*Attorney, Agent, or Firm*—Buell, Blenko, Ziesenheim & Beck

[57] ABSTRACT

A football passer is provided for passing a football in spiral fashion following a pre-set time delay from an apparatus which comprises a frame, a rigid guide rod fixed at one end on said frame and extending angularly upward therefrom to a free end, an elongate elastomeric sling fixed at opposite ends to said frame spaced on opposite sides of said free end of said guide rod, a latch on said frame adjacent said fixed one end of the guide rod, said latch engaging said elastomeric sling intermediate its ends when said sling is stretched along the guide rod to said one end, timer control on the frame at said one end of the guide rod controlling the release of said latch, and a football having a central axial end to end passage slidably received on said guide rod.

8 Claims, 3 Drawing Figures

FOOTBALL PASSING MACHINES

This invention relates to football passing machines and particularly to a football passing machine which not only can be set by the receiver to pass a football accurately to a predetermined area at a predetermined time, but also with a spiral twist in passage and in a very simple and inexpensive manner.

Football passing machines are not new. There have been many attempts made to provide a football passing machine which would throw a football over a considerable distance with reasonable accuracy. Such devices have basically been built around the principal of the catapault, which is itself an extremely old means of throwing an object through the air. Such machines generally simulate the motion of the human arm in throwing and are based upon the use of a large pivoting arm having a football receptacle at one end and powerful actuating springs at the other. Typical of such prior art football passing machines are those illustrated in Dixon U.S. Pat. Nos. 3,926,170 and 3,951,125 and Meyer U.S. Pat. No. 3,977,386. Each of these devices will effectively throw a football, however, they are expensive to manufacture, heavy in structure, must be firmly fastened in place and are difficult to control accurately. The slingshot principle has also been known and used for years as a means of projecting articles through space. This principle has been used in projecting a variety of objects, such as baseballs, of generally uniform shape. When used on an object of irregular shape the slingshot normally causes the object to flip-flop in end of end fashion through a much reduced distance and with little accuracy. One of the prior art devices using this principle for baseballs is that shown in Mike U.S. Pat. No. 3,802,409.

I have invented a portable football passer comprising a frame, a rigid guide rod fixed at one end to one end of the frame and extending angularly upwardly therefrom to a free end, an elongate elastomeric sling means fixed at its opposite ends to said frame spaced on opposite sides of said free end of said guide rod, latch means on said one end of said frame at said one end of said guide rod engaging the center of said elastomeric sling when said sling is stretched along the guide rod to said one end, timer control means controlling the releasing of said latch means and a football having a central passage extending from one point to the other point along the elongate axis of said football and adapted to slide on said guide rod to the latch means. Preferably a ball holder means is fixed to elastomeric sling at the center of the sling, having an opening adapted to receive the guide rod. The ball holder means is preferably provided with latch engagement means such that the elastomeric sling assumes a helical wind between the attached ends and the center when the latch means and ball holder means are engaged. Preferably, a retainer cord is attached between the ball holder and frame to prevent the ball holder from leaving the guide rod as the football is launched.

In the foregoing general description I have set out certain objects, purposes and advantages of my invention. Other objects, purposes and advantages of the invention will be apparent from a consideration of the following description and the accompanying drawings in which.

Figure 1:
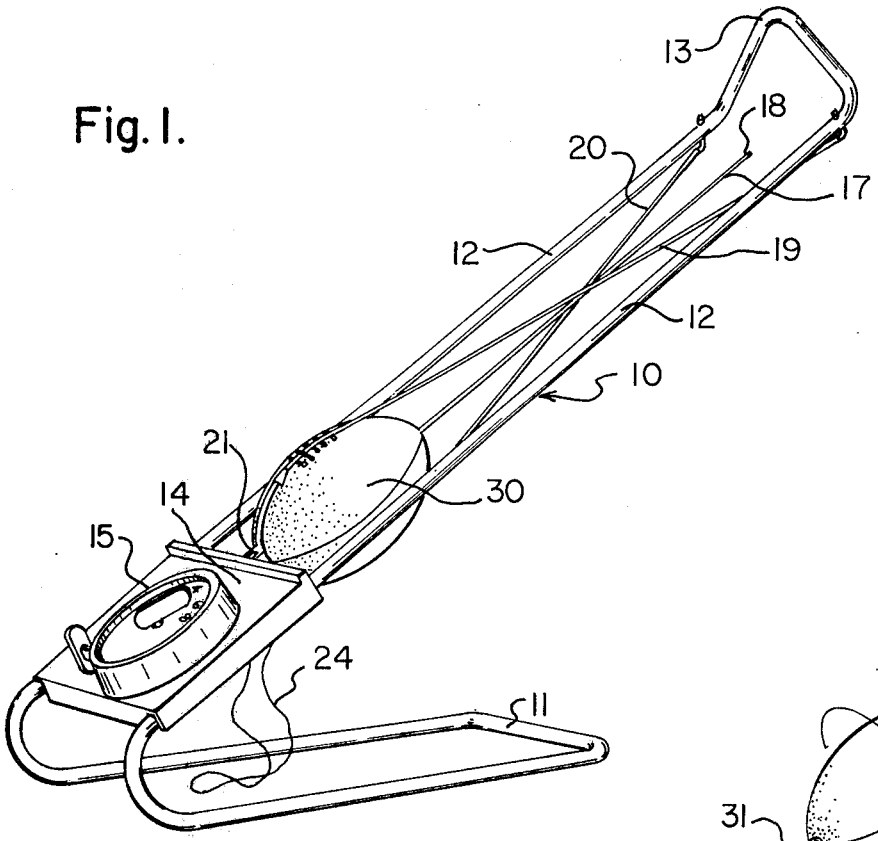
FIG. 1 is an isometric view of a football passer according to my invention.
Figure 3:
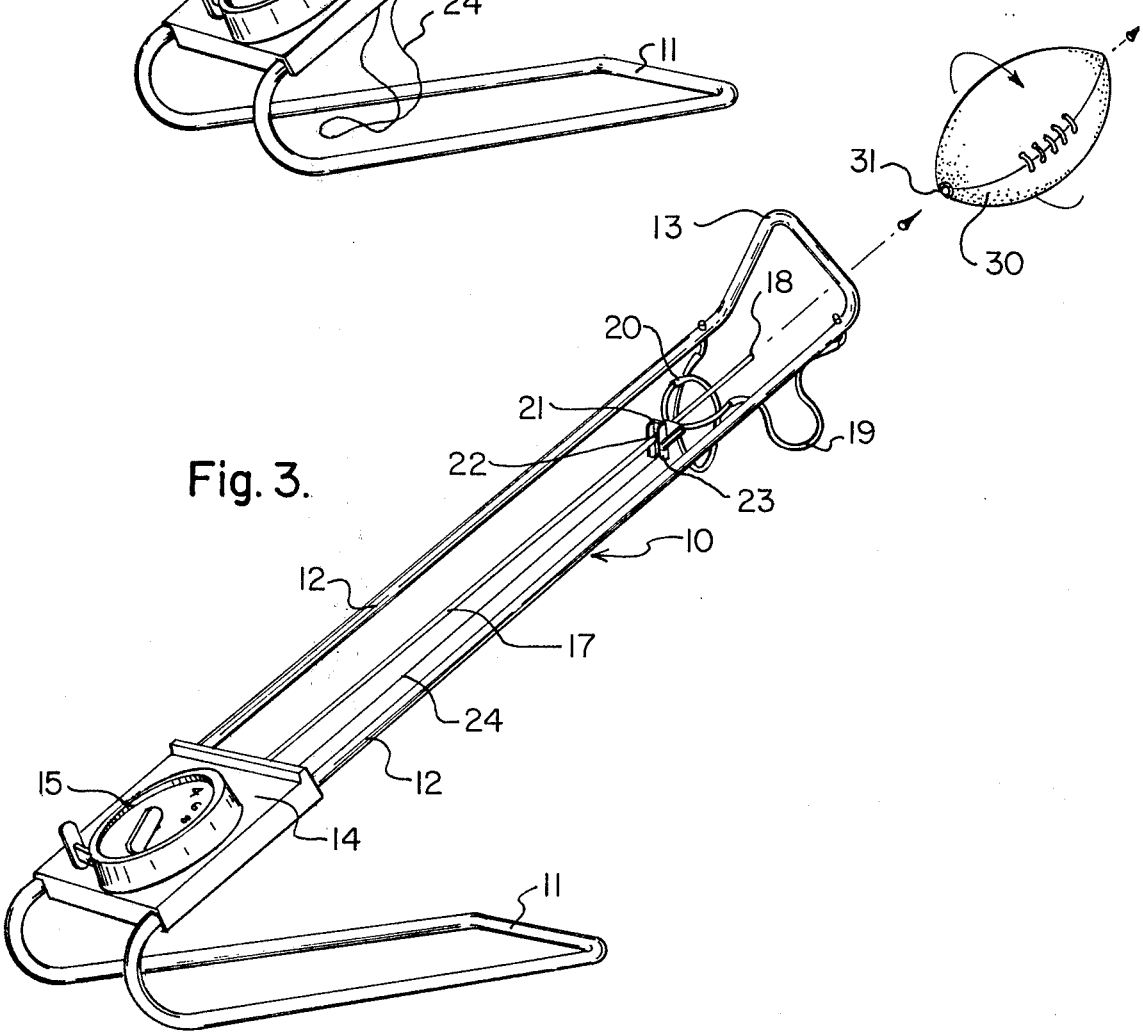
FIG. 3 is an isometric view of the apparatus of FIG. 1 with a football discharged therefrom.

Referring to the drawings, I have illustrated a football passing apparatus according to my invention including a frame 10 having a base 11 and a pair of parallel angularly upwardly extending arms 12 connected at their uppermost ends by arch 13. A ball holder latch assembly 14 is attached to arms 12 adjacent base 11. The ball holder latch assembly 14 includes a timer 15, a timer released latch means 16, and a guide rod 17 extending angularly upwardly intermediate and generally parallel to arms 12 to a free end 18 adjacent arch 13. A pair of elastomeric cords 19 and 20 are attached at one end to one of arms 12 adjacent arch 13. The other ends of elastomeric cords 19 and 20 are attached to opposite sides of a generally wishbone-shaped ball holder 21 having a hole 22 adapted to slide over guide rod 17. Ball holder 21 is provided with latch engagement means 23 adapted to be engaged by latch means 16. A retainer cord 24 is engaged at one end to ball holder 21 and at the other end to ball holder assembly 14 to limit the movement of ball holder 21 on the guide rod.

Figure 2:
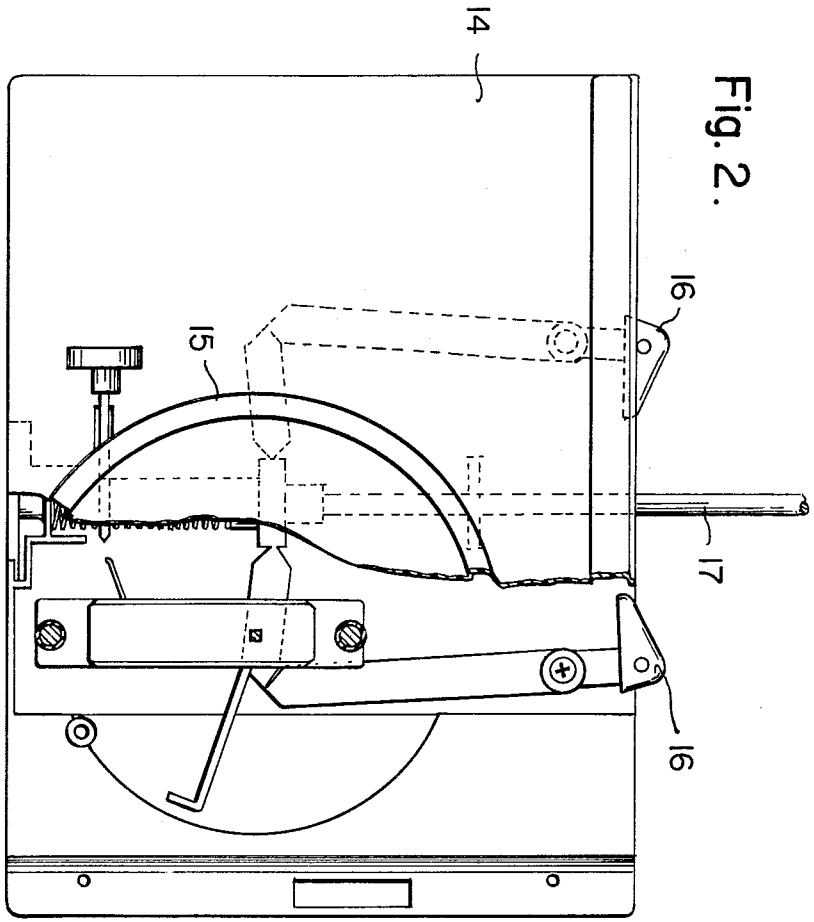
FIG. 2 is an enlarged fragmentary plan view of the ball holder and latch means of FIG. 1.

The ball holder latch assembly can be of any conventional form having latch fingers releasably engaging latch engagement means 23 and released by a timer mechanism. A preferred form of latch assembly is that shown in copending application of John P. Hancovsky and generally illustrated in FIG. 2 of this application.

In operation, the ball holder 21 is drawn down guide rod 17 and rotated 90° so that cords 19 and 20 are stretched and cross over and under guide rod 17. Ball holder 21 is latched in latch means 16. A football 30 having an axial extending passage 31 from end to end is passed over guide rod 17 through passage 31 until it rests in ball holder 21. The timer 15 is set for the desired time of release. The person who will run out toward the reception area and the timer releases the latch means 16 at the expiration of the allotted time, at which time the elastomer cords draw the ball holder rapidly up rod 17 along with ball 30 and rotate it as the elastomer cords straighten out so that as ball 30 leaves guide rod 17 it is spiralling around its reception area.

In the foregoing specification I have set out certain preferred practices and embodiments of my invention; however, it will be understood that this invention may be otherwise embodied within the scope of the following claims.

I claim:

1. A football passer comprising a frame, a rigid guide rod fixed at one end on said frame and extending angularly upward therefrom spaced from the frame over its entire length to a free end, an elongate elastomeric sling means fixed at opposite ends to said frame spaced on opposite sides of said free end of said guide rod, latch means on said frame adjacent said fixed one end of the guide rod, said latch means engaging said elastomeric sling means intermediate its ends when said sling is stretched along the guide rod to said one end, timer control means on the frame at said one end of the guide rod controlling the timed release of said latch means and said elastomeric sling means, and a football having a central axial end to end passage slidably and rotatably received on said guide rod and freely movable, under impulse of said elastomeric sling means along the entire length of said guide rod spaced from the frame.

2. A football passer as claimed in claim 1 wherein ball holder means is fixed to the elastomeric sling at the center thereof intermediate the ends, having an opening adapted to receive slidably and rotatably the guide rod and provided with latch engagement means.

3. A football passer as claimed in claim 2 wherein the ball holder means is of wishbone shape with bifurcated arms engaging the end of the football.

4. A football passer as claimed in claims 2 or 3 wherein retainer means is provided on the frame to prevent the ball holder means from leaving the guide rod.

5. A football passer as claimed in claim 4 wherein the retainer means is a cord connecting the frame and ball holder means.

6. A football passer as claimed in claim 1 or 2 or 3 wherein switch means is provided to start the timer control means.

7. A football passer as claimed in claim 1, 2 or 3 wherein the frame is made of tubing bent to form a generally rectangular base and a pair of substantially parallel angularly upwardly extending arms connected by a curved yoke at their uppermost ends and by a ball holder assembly adjacent the base.

8. A football passer as claimed in claim 7 wherein the ball holder assembly includes the timer and latch means.

* * * * *